United States Patent [19]

Eliassen

[11] 4,022,363

[45] May 10, 1977

[54] DEVICE FOR CARRYING AND STORING BOTTLES

[76] Inventor: Gunnar Thure Eliassen, Stenbocksgatan 13, S-661 00 Saffle, Sweden

[22] Filed: Sept. 10, 1975

[21] Appl. No.: 611,936

[30] Foreign Application Priority Data

Sept. 11, 1974 Sweden ..... 7411458
Aug. 21, 1975 Sweden ..... 7509323

[52] U.S. Cl. ..... 224/45 AA; 206/199; 211/60 R; 211/74; 248/74 A; 248/312; 294/87.2; 294/87.28

[51] Int. Cl.[2] ..... B65D 71/00

[58] Field of Search ..... 224/45 AA, 45 A, 48 A, 224/48 C; 294/87.2, 87.28; 211/74, 60 R, 60 T, 162, 89; 206/199, 201, 150, 427; 248/312, 74

[56] References Cited

UNITED STATES PATENTS

| | | | |
|---|---|---|---|
| 2,420,191 | 5/1947 | Ransom | 294/87.28 |
| 2,558,182 | 6/1951 | Killingsworth | 211/74 X |
| 2,816,667 | 12/1957 | Tanay | 248/312 X |
| 3,086,805 | 4/1963 | Dardaine et al. | 294/87.2 X |
| 3,414,313 | 12/1968 | Schwarz | 294/87.2 |
| 3,524,671 | 8/1970 | Akeireb | 294/87.2 |
| 3,527,345 | 9/1970 | Iorio | 294/87.2 |
| 3,633,962 | 1/1972 | Erickson | 294/87.2 |

FOREIGN PATENTS OR APPLICATIONS

| | | | |
|---|---|---|---|
| 513,643 | 2/1955 | Italy | 294/87.2 |

*Primary Examiner*—L. J. Paperner
*Assistant Examiner*—Donald W. Underwood
*Attorney, Agent, or Firm*—Sughrue, Rothwell, Mion, Zinn & Macpeak

[57] ABSTRACT

A device for carrying and storing bottles is disclosed. The device generally has a holder frame utilizing a series of parallel rails inside the frame. The rails form between them uniform gaps and the edges of the rails have edge portions which yield upon introduction of the bottle neck and then squeeze the neck into a locking arrangement when the bottle is moved in a direction perpendicular to the plane defined by the holder. The edge portions comprise two strip lids which run parallel to each other, but which diverge and are formed of a soft yielding material.

9 Claims, 5 Drawing Figures

DEVICE FOR CARRYING AND STORING BOTTLES

The invention relates to a device for carrying and storing bottles, comprising a plurality of rails arranged side by side on a holder, to form substantially equally wide spaces between their opposing edges, said edges having yielding edge portions which, on introduction of the neck of a bottle, form locking means for squeezing fast the neck.

The main object of the invention is to provide a device of said type, which retains the bottle without this needing to be supported further and thus can hang freely without risk of coming loose.

Another object is to provide a device of said type which not only keeps the bottle hanging steady but also permits pushing the bottle neck from either side of the holder, which can thus be made as a simple and cheap plate with little volume.

These and other objects are realized completely with the invention which is defined in the patent claims, and which is described below in conjunction with the attached drawings showing two embodiments of the invention.

Figure 1:
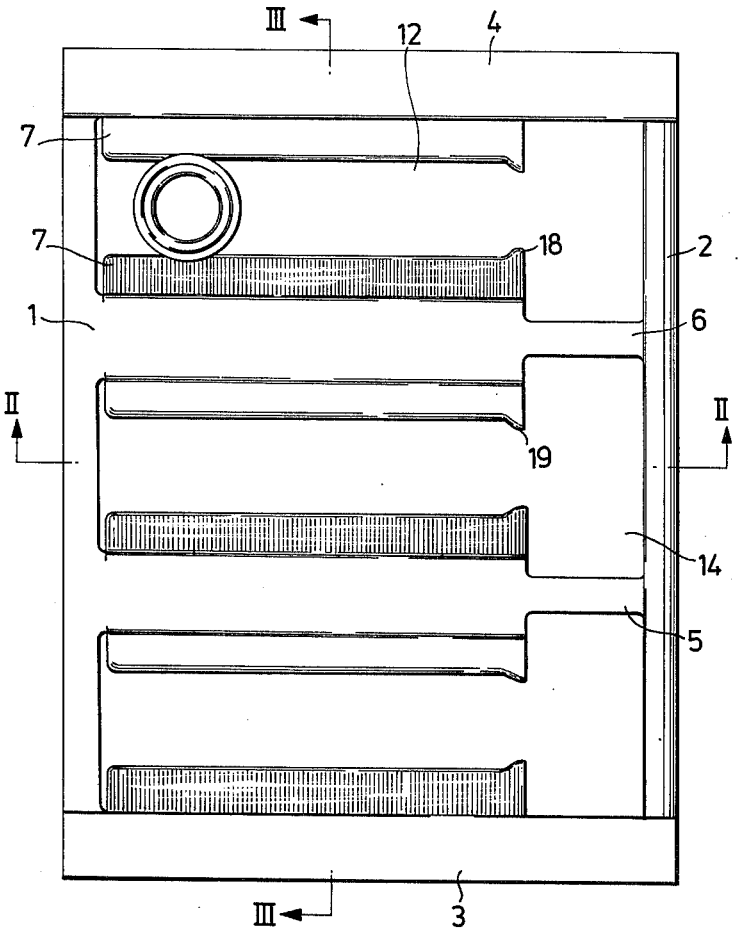
FIG. 1 shows a device according to the invention seen from below or above.
Figure 2:
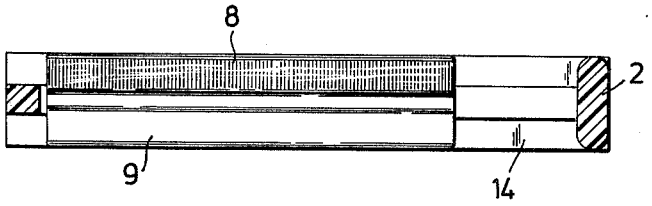
FIG. 2 is a sectional view along line II-II in FIG. 1.
Figure 3:
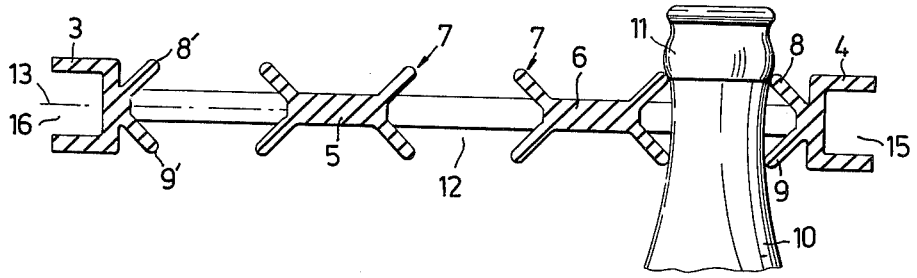
FIG. 3 is a sectional view along line III-III in FIG. 1.

The invention is first described while referring to the FIGS. 1–3.

A rectangular holder in the shape of a frame with end pieces 1 and 2 and side pieces 3 and 4 support rails 5 and 6 between the end pieces 1, 2. The rails 5, 6 are provided with retaining or locking means generally designated 7 on their edges which are parallel to each other. As best may be seen from FIG. 3 each locking means 7 is shaped as two lips 8 and 9, respectively, diverging from each other. The lips 8, 9 are shown here as being formed directly on the respective rail 5, 6, and resilient plastic can be mentioned as a suitable material. The frame 1, 2, 3, 4, the rails 5, 6 and the lips 8, 9 can be moulded integrally. On their edges facing the interior of the frame, the side pieces 3 and 4 are similarly provided with lips 8, 9. The distance between two opposing pairs of lips 8, 8 and 9, 9, respectively, is less than the diameter on the neck ring 11 of a bottle 10. When a bottle is introduced into the gap 12, which is to be found between both the locking means 7 facing each other, the lower lips 9 will be pressed upwardly by the neck ring 11, and when the neck ring has passed the lips 8 they will fall back to approximately the position shown in FIG. 3. During the continued upward movement of the bottle 10, substantially at right angles to the plane of the frame 1, 2, 3, 4, the neck ring 11 will move the lips 8 upwards. When the lower edge of the neck ring 11 has come above the lips 8, the bottle is relinquished and the lips 8 grip the lower edge of the neck ring 11. If one attempts to pull the bottle downwards, the grip is increased between the lips 8 and the bottle neck. The bottle neck is not only held fast in this position by two coacting lips 8, but is also supported by the underlying lips 9, any tendancy of the bottle to swing right or left in FIG. 3 being effectively prevented, and thereby the risk is not run that bottles in adjacent rows knock against each other.

The distance between the outer lip edges 8′, 9′ of each locking means is made as large as possible to obtain good stabilization of the bottles, and the distance should be at least 2 cm if the lip material is soft. As may be seen from FIG. 3 the lips 8, 9 diverge symetrically from a central plane 13 through the device, and this allows introduction of bottles from either side of the plane.

The locking means 7 does not extend along the whole length of the rails, as may be seen from FIG. 1. The reason for this is that each bottle shall be able to be drawn out into the spaces 14 and then moved downwards for removal from the device. Each space 14 forms, together with the portion of the adjacent end piece 2 defining the space, a handhold for easily carrying the device with bottles in place. As shown in FIG. 2, the end piece 2 suitably has a rounded-off section for sitting comfortably in the holder's hand.

In the embodiment shown, the side pieces 3, 4 which also form strips for locking means are also provided with longitudinal guiding grooves 15 and 16, respectively, whereby the frame can be pushed into a rack or the like having slide rails.

Figure 4:
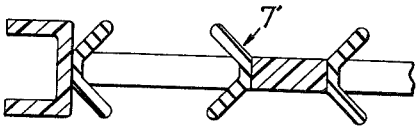
FIG. 4 shows a modified embodiment of the locking strips.

In FIG. 4 the locking means 7′ is shown consisting of V-shaped means which are fixedly mounted on respective rail edges, e.g. on the rail 6′. The locking means 7 can thus be manufactured in a soft material, e.g. rubber, while the remainder of the device is manufactured from wood, plastic or metal having a good capacity for taking up loads.

To prevent the bottles from gliding out into the openings 14, it can be appropriate to provide the ends of the locking means with hooks or projections 18, 19 which are formed on the lips. The engagement edges of the lips 8, 9 can be made fluted or provided with some frictional coating to increase the grip on the bottles.

Locking means of the type described, with two lips diverging from each other can also be used on other types of holder, e.g. the type which is described below in conjunction with FIG. 5.

Figure 5:
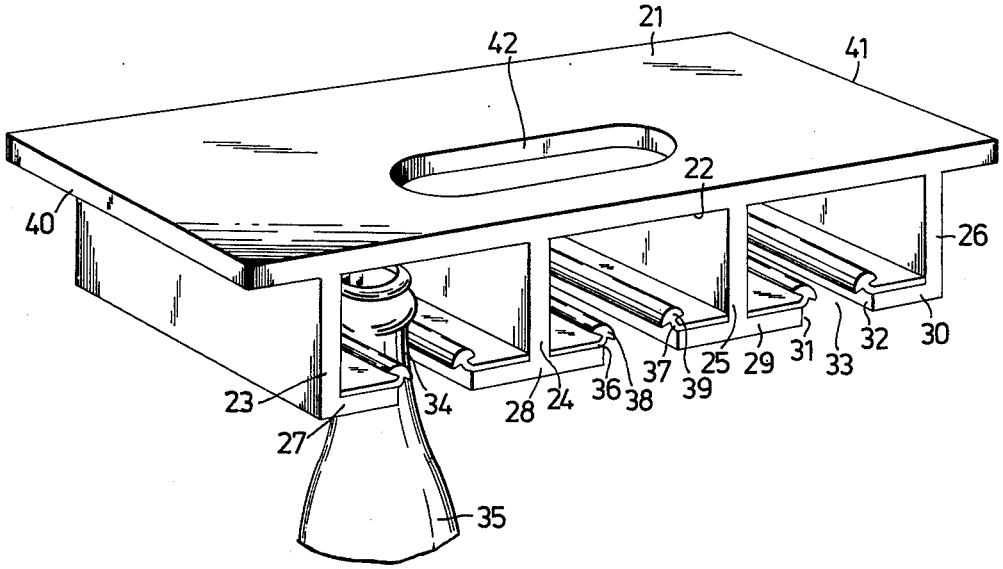
FIG. 5 shows a further embodiment.

In FIG. 5 is shown a rectangular plate 21 which has walls 23, 24, 25 and 26 depending from its lower surface 22, said walls forming between themselves spaces with substantially the same width. The walls 24–26 have substantially the same height and thickness. Rails 27, 28, 29 and 30, respectively, are connected to the lower edges of the walls which are parallel with each other. The rails have edges which are parallel with and facing each other, e.g. the edges 31 and 32, and between the pairs of edges are formed uniformly wide gaps, e.g. the gap 33. Each gap has a width exceeding the diameter of the neck 34 on a bottle 35, and the neck 34 can thus be introduced into a storing position in the respective gap.

For positively squeezing fast the bottles 35, dependent from the pairs of rails, there is an elastic locking means along the respective rail, e.g. locking means 36 and 37 between the rails 28 and 29. In the embodiment shown, the locking means consists of rubber strips or strips of similar material which are fixedly mounted along the edges of the rails on the side surfaces facing the plate 21. Each locking strip 36, 37 has a bead 38 and 39, respectively, extending into the gap between the edges of the rails and which gives way if the bottle 35 is introduced into the gap directly from below or from the side, to allow the opening of the bottle to pass, but which, when the bottle is relinquished and hangs vertically, positively closes round the neck and retains the bottle.

The opposite edges 40 and 41 of the plates project outside the walls 23 and 26, respectively, to form runners which can be introduced into grooved strips or the like which are mounted under a shelf in a larder, for example. There is a handhold for carrying the bottle holder, the handhold here being shown to consist of an opening 42 in the plate 21.

The shown embodiment can be modified in different ways within the scope of the patent claims. The locking means shown do not need to be made in the form of a continuous strip provided with a bead, but can consist for example of abutments or the like, e.g. made of rubber, which are distributed along the respective rail edge. The plate 21 can be replaced by a frame on which the walls are mounted, and the walls can be replaced, e.g. by pegs which project downwards from the frame and are attached to the rails. It is similarly possible to provide the rails with holes for reducing the total weight.

I claim:

1. In a device for carrying and storing bottles having a plurality of rails arranged side by side on a holder between their opposing edges forming substantially uniformly wide gaps, said edges having yielding edge portions forming locking means which, on the introduction of the neck of a bottle, squeeze the neck fast, the improvement characterized in that said locking means comprises a strip of elastic material extending along and outside the edge of an associated rail and arranged to give way in the direction of introduction on introducing the neck of a bottle in a direction substantially at right angles to a plane defined by said holder, and on movement of the neck in an opposite direction to be squeezed tightly against it, and each strip mounted on the side of the respective rail facing away from the gap and has a bead lying outside and parallel with the edge of the rail facing the gap.

2. A device as claimed in claim 1, characterized in that the rails are fixed relative to each other by means of a holder comprising a plate means with walls projecting from one side surface which are parallel with and of equal height, the outer edges of said walls each being firmly joined to a rail.

3. A device as claimed in claim 2, characterized in that the plate means is rectangular with two opposing side edges projecting outside adjacent walls to form runner flanges coacting with guiding means.

4. A device as claimed in claim 3, characterized in that the plate means on its surface facing away from the walls has at least one handhold.

5. In a device for carrying and storing bottles having a plurality of rails arranged side by side on a holder, said rails forming substantially uniformly wide gaps between their opposing edges, each edge of each rail having yielding edge protions comprised of two strip-like lips, said two strip like lips diverging from each other and extending outwardly from their rails to form with opposed corresponding strip-like lips a locking means which, on the introduction of the neck of a bottle, squeeze the neck fast, the improvement characterized in that each locking means comprises a strip of elastic material extending along and outside the edge of an associated rail and arranged to give way in the direction of introduction on introducing the neck of a bottle in a direction substantially at right angles to a plane defined by said holder, and on movement of the neck in an opposite direction to be squeezed tightly against it.

6. A device as claimed in claim 5, characterized in that each locking means forms an integral part of the associated rail.

7. A device as claimed in claim 5, characterized in that each locking means constitutes a separate unit fixedly mounted on an associated rail.

8. A device as claimed in claim 7, characterized in that each locking means is manufactured from a softer material than the associated rail.

9. A device as claimed in claim 8, characterized in that each locking means has a V-shaped cross-sectional area.

* * * * *